US007258165B1

(12) United States Patent
Williams

(10) Patent No.: US 7,258,165 B1
(45) Date of Patent: Aug. 21, 2007

(54) HOLE OPENER AND DRILLABLE CASING GUIDE AND METHODS OF USE

(76) Inventor: Donald L. Williams, 202 Holstein, Youngsville, LA (US) 70592

( * ) Notice: Subject to any disclaimer, the term of this patent is extended or adjusted under 35 U.S.C. 154(b) by 268 days.

(21) Appl. No.: 11/036,450

(22) Filed: Jan. 15, 2005

(51) Int. Cl.
*E21B 7/06* (2006.01)
*E21B 10/26* (2006.01)

(52) U.S. Cl. ..... 166/117.5; 175/57; 175/73; 175/385; 175/326; 175/171

(58) Field of Classification Search ..... 166/117.5; 175/57, 73, 171, 326, 385
See application file for complete search history.

(56) References Cited

U.S. PATENT DOCUMENTS 4,114,705 A * 9/1978 Milan ..... 175/340
4,433,738 A * 2/1984 Moreland ..... 175/61
4,640,371 A * 2/1987 Moraly ..... 175/61
4,768,599 A * 9/1988 Eischeid ..... 175/79
6,722,451 B2 * 4/2004 Saugier ..... 175/57
2005/0133268 A1 * 6/2005 Moriarty ..... 175/61

FOREIGN PATENT DOCUMENTS

DE 3927625 A1 * 2/1991

* cited by examiner

*Primary Examiner*—William Neuder
*Assistant Examiner*—Nicole A Coy
(74) *Attorney, Agent, or Firm*—Robert N. Montgomery

(57) ABSTRACT

A down-hole tool guide is disclosed for deflecting various down-hole tools having a tendency to hang or bind in uncased bore holes. The down-hole tool guide or ball guide assembly, being adaptive to the down-hole tools, extends forwardly there from and includes an eccentric rotatable ball and high-pressure jets. In cases where the guide is used to guide casing, the ball guide assembly is constructed from a drillable material thereby allowing the hole bore to be extended beyond the last set casing depth without side deviation from the original bore.

18 Claims, 4 Drawing Sheets

HOLE OPENER AND DRILLABLE CASING GUIDE AND METHODS OF USE

FIELD OF THE INVENTION

This invention relates generally to hole opening operations and casing insertions in deviated hole bores and more particularly to a guide tool used to facilitate such operations.

GENERAL BACKGROUND

Generally hole-opening operations down-hole involve the use of a hole-opening tool to enlarge a well bore. Such tools include a tool body configured for attachment at an upper end to a rotary drill string or the like and a lower end connected to a bull nose or radial member used for positioning and guiding the tool into and though the well bore to be enlarged. The tool further includes plurality of vertically extending slots each of which is configured to receive a removable cutter assembly adapted for rotation and retention therein. As the tool rotates, the cutters also rotate as a result of contact with the walls of the borehole, thus enlarging the bore to the size of the major diameter of the cutters. The bull nose serves as a guide through the previously drilled borehole. However, the previously drilled bore hole is by no means a well defined smooth or straight bore and often contains numerous cavities due to the differences in materials in the formation. It has been observed that the bull nose tip attached to the hole opening tool often jams into the crevices and sharp formations, especially in deviated holes approaching the horizontal, causing severe damage to the tool requiring retrieval and replacement of the hole opening tool. Therefore, a more reactive guide is needed to deflect the hole-opening tool around pits and in-penitratable projections.

In addition, it has also been observed that significant problems arise when attempting to insert and set casing in a bored hole. Intermediate casings are equipped with a flared flange at the lower end, extending outward between the casing outside diameter and the hole bore size, thus forming the base of the casing annulus. This flared or flanged casing must be negotiated though the bored hole and often becomes wedged or jammed in the crevices or pockets, discussed above, causing withdrawal and rotation of the casing in order to get past the obstruction. Therefore, a more reactive guide is needed to defect the casing flange around the pits and crevices. The following description of a down-hole guide tool has proved effective in solving the above-described problems.

SUMMARY OF THF INVENTION

A down-hole tool guide is disclosed for deflecting various down-hole tools having a tendency to hang or bind in uncased bore holes. The down-hole tool guide or ball guide assembly being adaptive to the down-hole tool extends forwardly there from and includes an eccentric rotatable ball and high-pressure jets. In cases where the guide is used to guide casing, the ball guide assembly is constructed from a drillable material thereby allowing the hole bore to be extended beyond the last set casing depth without side deviation from the original bore.

BRIEF DESCRIPTION OF THF DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THF PREFERRED EMBODIMENT

Figure 1:
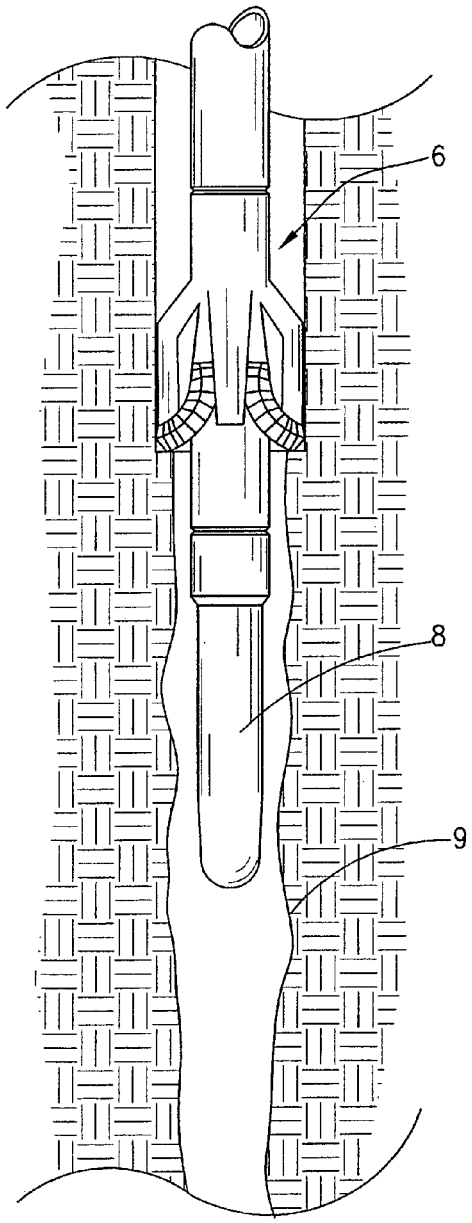
Fig. 1 PRIOR ART
FIG. 1 is a down-hole cross-section view of the prior art general arrangement of a hole-opener tool.
Figure 2:
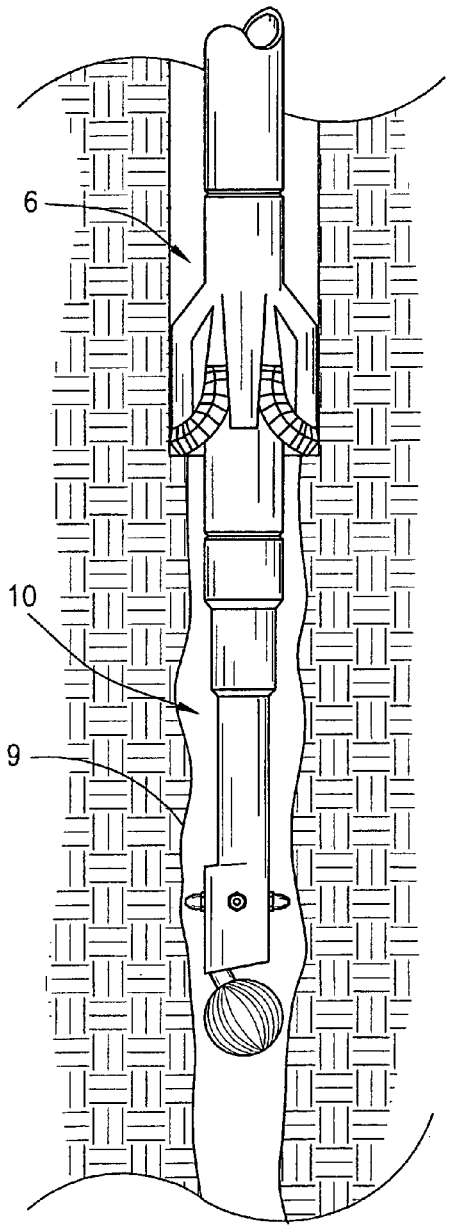
FIG. 2 is a down-hole cross-section view of the hole-opener tool, seen in FIG. 1, with the preferred embodiment of the tool guide.

As may be seen in FIG. 1, hole opening tool assemblies 6 are generally fitted with a bull nose guide 8 when sizing the rough bore 9. Such bull nose guides 8 are usually fabricated from a drill pipe sub and are seldom of uniform shape, size or construction. These guides 8 are easily produced and are often replaced due to the abusive nature of the environment to which they are subjected. Sharp rocks and acute variations of the bore 9 often badly distort the bull nose guides 8 making them unusable. Utilizing the heavy-duty down-hole ball guide assembly 10, as seen in FIG. 2, in place of the bull nose sub 8 ensures a smother transition of the hole opener assembly 6 through the bore 9 by rolling over and around obstacles and by providing jetting to clean the path of the hole opening tool assembly 6 while rotating.

Figure 3A:
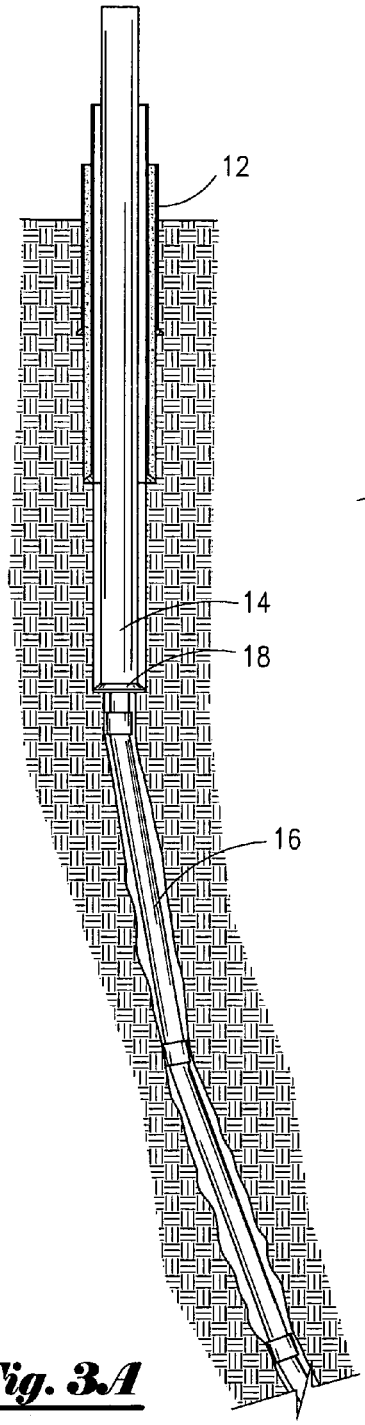
FIG. 3A is a down-hole cross-section view of a casing string in a deviated bore.
Figure 3B:
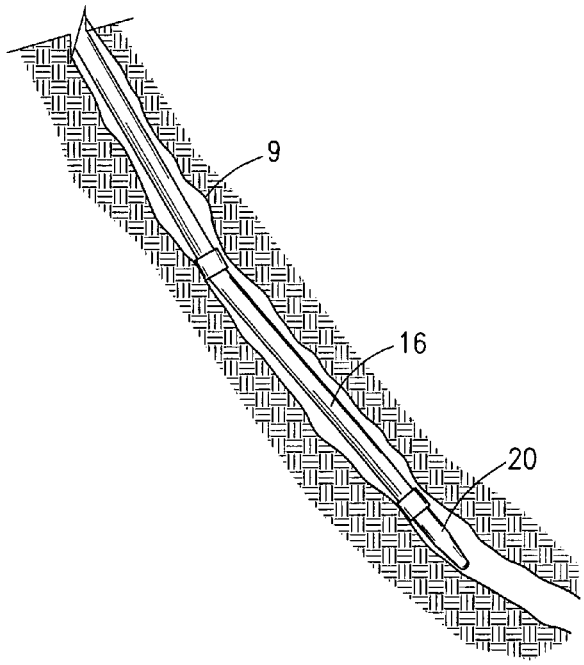
FIG. 3B is a continuation of the down-hole cross section view of a casing string in a deviated bore, shown in FIG. 3A, with bull nose attachment.
Figure 4A:
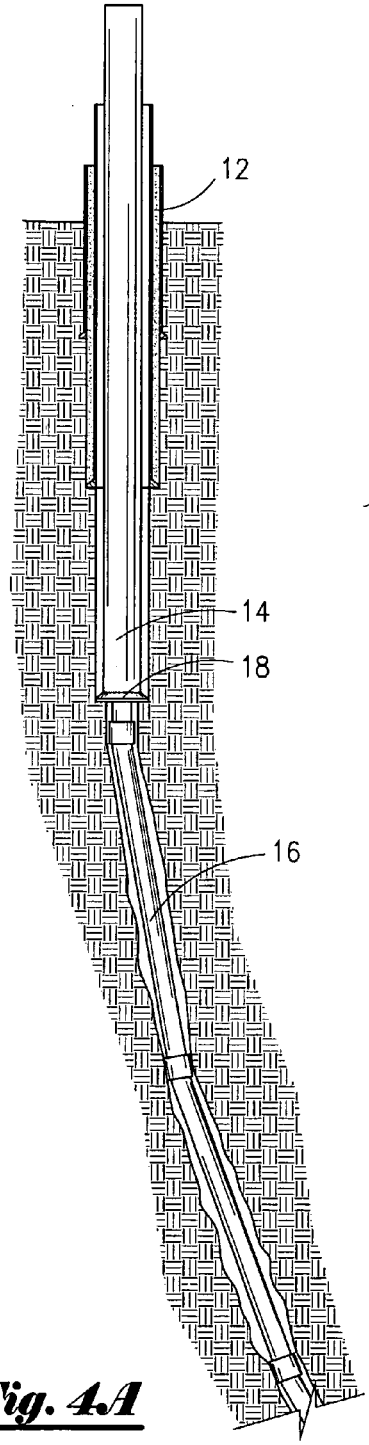
FIG. 4A is a down-hole cross-section view of a casing string in a deviated bore as seen in FIG. 3A.
Figure 4B:
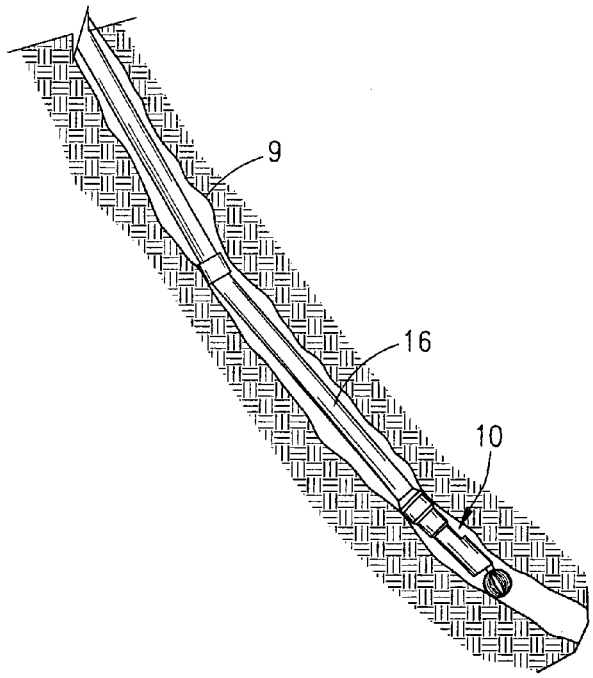
FIG. 4B is a continuation of the down-hole cross section view of a casing string in a deviated bore, shown in FIG. 4A, with drillable guide attachment.

A second operation involves the installation of jointed casing in the bored hole, as shown in FIGS. 3A, 4A and 3B, 4B. As those in the art are aware, an initial drive casing 12 is set and subsequent casings, 14, 16 are set and cemented in place as the well bore progresses. A flared lip or flange 18, at the lower end of each string of casing, is sized to establish the annulus of the bore to be filled with cuttings and cement. This flared flange 18 is difficult to insert in the bore, even in smooth bores, and is made even more difficult in deviated holes especially as the deviation approaches the horizontal, as shown in FIG. 3B. The final casing string may be fitted with a casing bull nose guide 20 to help guide the casing to its final depth. Since the casing is not withdrawn and is set in place, the casing must be perforated above the casing bull nose 20, so it can be displaced down-hole, to allow for the production tubing string to be installed in the well. It is therefore anticipated that a ball guide tool assembly 10, seen in FIG. 4B, may be adapted to the casing to better assist in guiding the final casing string 16. Further, if the ball guide tool is made of a drillable material such as aluminum, bronze, brass, copper or other such relatively soft metal or composite materials having equivalent strengths. It would then be possible to simply drill through the ball guide assembly 10 with an earth boring drill bit thereby destroying the ball guide assembly and allowing continuation the well bore if necessary.

Figure 5:
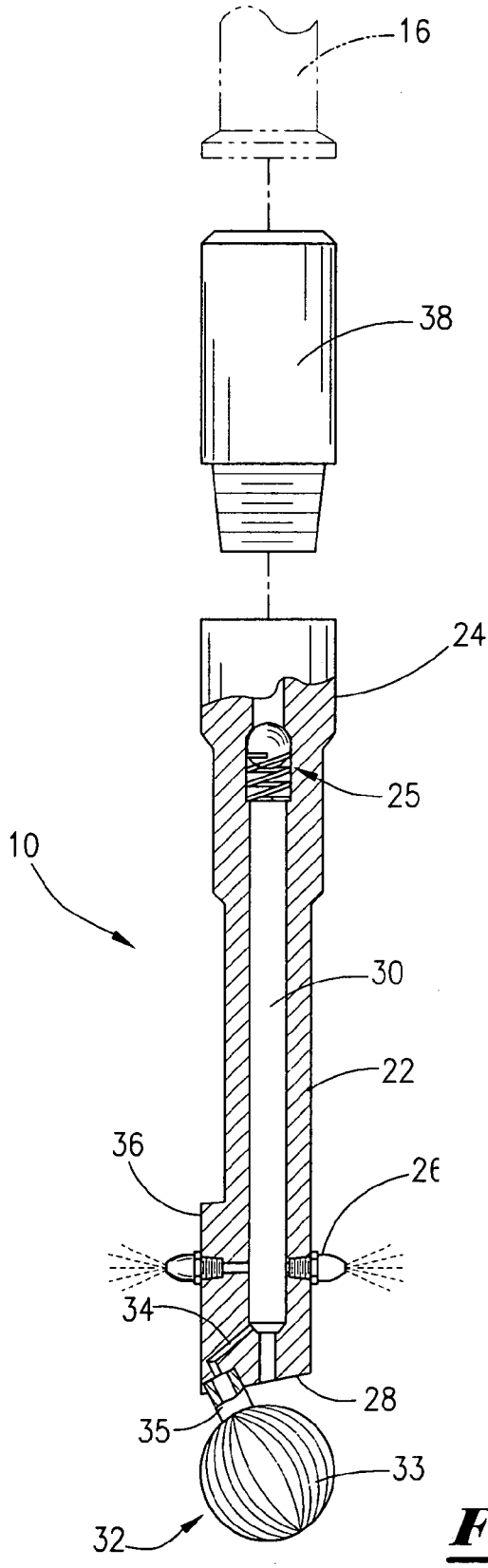
FIG. 5 is a cross section view of the guide attachment and casing adapter.

As shown in FIG. 5, the down-hole tool ball guide assembly 10 includes a tubular body portion 22 having an upset threaded end 24 which is bored and fitted with an internal ball check assembly 25 to prevent back flow from the well bore through the tool but still allow pressurized fluids from the surface to reach jetting nozzles 26 through the central bore 30. The pressurized fluids also provide lubrication to bearings in the ribbed ball assembly 32 via porting 34 and help flush debris from the ball. The ball assembly 32 is generally spherical in shape having external ribs or teeth 33 defined by a plurality of longitudinal grooves extending parallel to the central axis of the ball. The ball assembly 32 is a minor non-aggressive cutting bit, having the ability to clear minor obstacles and thus provide a reaming action as it rolls against the wall of the bore 9 as it spirals downward without side tracking the well bore 9. It should also be noted, that the ball 32 is arranged in a manner whereby the major diameter of the ball extends diametrically beyond the major diameter of the offset eccentric portion 36 of the body portion 22. The ball is rotatable about a tubular shaft 35 attached to the truncated portion 28 of the eccentric portion 36 of the body portion 22. The tubular shaft 35 is also ported to allow the previously mentioned pressurized surface fluids to lubricate internal bearings. Seals located within the ball assembly 32 prevent internal contamination of the internal bearings from down-hole debris.

An adaptor 38 may be provided that is threadably connected at one end to the ball guide assembly 10 and welded to the casing 16 in a seamless manner to reduce the possibility of hang-ups by the flared end of the casing.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A tubular ball guide assembly attachable to down-hole tubular members and tools comprising a tubular body portion having an eccentric portion at one end and an upset threaded portion for connecting to said downhole tubular members at the opposite end, the eccentric portion having an oblique truncated face, and a rotatable ball assembly attached perpendicular to said truncated face.

2. The ball guide assembly according to claim 1 wherein said body portion further comprises an internal check means adjacent the upset threaded portion.

3. The ball guide assembly according to claim 1 wherein the body member further comprises a plurality of high pressure jetting nozzles located externally around the eccentric portion.

4. The ball guide assembly according to claim 3 further comprising porting means for passing pressurized fluids from the surface of the well bore to the jetting nozzles and to bearings within the rotatable ball.

5. The ball guide assembly according to claim 1 wherein the rotatable ball assembly further comprises a plurality of external ribs.

6. The ball guide assembly according to claim 1 wherein said body member is fabricated from aluminum.

7. The ball guide assembly according to claim 1 wherein said body member is fabricated from a composite material capable of being cut by an earth boring drill bit.

8. The ball guide assembly according to claim 1 further comprising an adaptor for connecting the ball guide assembly to the flared end of a casing.

9. The ball guide assembly according to claim 1 wherein the ball guide assembly is connected to a hole opening tool assembly.

10. A ball guide assembly for down-hole tools comprising:

a) a tubular body member having a threaded upset at one end and an eccentric portion at the opposite end said eccentric portion being truncated at an acute angle;

b) a tubular shaft attached to the eccentric portion perpendicular to the acute angled truncation;

c) a spherical ball attached to and rotatable about the tubular shaft the ball having external longitudinal grooves parallel with the central axis defining a plurality of teeth extending radially around the ball; and d) a biased ball check means for preventing back flow of fluids through the tubular body member located internally adjacent the threaded upset.

11. The ball guide assembly for down-hole tools according to claim 10 wherein said ball guide assembly further comprises pressurized jetting means located externally along the tubular body member for washing away debris and cleaning the ball down-hole.

12. The ball guide assembly for down-hole tools according to claim 10 wherein said ball guide assembly is connected to a hole opening tool assembly.

13. The ball guide assembly for down-hole tools according to claim 10 wherein said ball guide assembly is adaptively attached to a casing string.

14. The ball guide assembly for down-hole tools according to claim 10 wherein said ball guide assembly is constructed from a material selected from a group consisting of aluminum, bronze, brass and copper.

15. A method for guiding down-hole tools through a rough bored hole comprising the steps of:

a) providing a down-hole ball guide assembly comprising a tubular body member having an eccentric portion at one end and an upset threaded portion at the opposite end the eccentric portion being truncated at an acute angle and a rotatable ball assembly attached perpendicular to the truncated portion;

b) attaching the ball guide assembly to a hole opening tool being inserted into a rough bored non-cased hole; and c) pressurizing the ball guide assembly with fluids from the surface.

16. The method according to claim 15 further comprising the step of milling the wall of a well bore with the ball guide assembly.

17. The method according to claim 15 further comprising the step of attaching the ball guide assembly to a casing string.

18. The method according to claim 17 further comprising the step of drilling through the ball guide assembly thereby destroying the ball guide assembly with an earth boring bit extending through the casing string in a manner whereby the drill bit continues the well bore beyond the casing string.

* * * * *